US009263831B2

(12) United States Patent
Shen

(10) Patent No.: US 9,263,831 B2
(45) Date of Patent: Feb. 16, 2016

(54) PLUG HAVING IMPROVED RELEASE MECHANISM

(71) Applicant: FOXCONN INTERCONNECT TECHNOLOGY LIMITED, Grand Cayman (KY)

(72) Inventor: Yi-Lung Shen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/567,399

(22) Filed: Dec. 11, 2014

(65) Prior Publication Data

US 2015/0162709 A1 Jun. 11, 2015

(30) Foreign Application Priority Data

Dec. 11, 2013 (CN) ..... 2013 1 0666908

(51) Int. Cl.
*H01R 13/627* (2006.01)
*H01R 13/629* (2006.01)

(52) U.S. Cl.
CPC ..... *H01R 13/62933* (2013.01); *H01R 13/6272* (2013.01)

(58) Field of Classification Search
CPC ..... H01R 13/6272; H01R 13/6273; H01R 13/6275; H01R 13/641
USPC ..... 439/352, 358
See application file for complete search history.

(56) References Cited

U.S. PATENT DOCUMENTS

| | | | | |
|---|---|---|---|---|
| 6,926,551 | B1 | 8/2005 | Schulz et al. | |
| 6,929,403 | B1 | 8/2005 | Arciniegas et al. | |
| 7,147,502 | B1 * | 12/2006 | Wu | H01R 13/6275 439/352 |
| 7,204,712 | B2 | 4/2007 | Schwiebert et al. | |
| 7,207,823 | B1 * | 4/2007 | Yang | H01R 13/6275 439/352 |
| 7,281,937 | B2 | 10/2007 | Reed et al. | |
| 7,534,125 | B1 | 5/2009 | Schroll | |
| 8,348,681 | B2 * | 1/2013 | Phillips | G02B 6/3887 439/99 |
| 8,403,695 | B2 * | 3/2013 | Wang | H01R 13/6335 385/92 |

* cited by examiner

*Primary Examiner* — Hien Vu
(74) *Attorney, Agent, or Firm* — Ming Chieh Chang; Wei Te Chung

(57) ABSTRACT

A plug (100) is configured for latching engagement with a cage (200). The plug has a housing (10) and a release mechanism (12) mounted on the housing. The housing has a nose portion (11) configured for latching engagement with a latch tab (21) formed on the cage. The release mechanism includes a rotatable lever (123) and a movable actuator arm (124). The lever has a front portion (1231), a rear portion (1232) and a middle portion (1234) adapted to be hinged with the housing. A front portion (1241) of the actuator arm could lift the front portion of the lever for releasing the nose from the latch tab when the actuator arm is moved forwardly, and a rear portion (1243) of the actuator arm could lift the rear portion of the lever when the actuator arm is moved backwardly.

7 Claims, 4 Drawing Sheets

PLUG HAVING IMPROVED RELEASE MECHANISM

BACKGROUND OF THE INVENTION

1. Field of the Invention

The present invention relates to a plug having an improved releasing mechanism.

2. Description of Related Art

U.S. Pat. No. 7,204,712, issued to Schwiebert et al. on Apr. 17, 2007, discloses a module plugged into a cage. The module has a housing including a top wall, and a release mechanism assembled to the top wall. The cage has a resilient latch tab adapted to receive a post formed on the housing top wall. The release mechanism includes an integrated structure having a wedge-shaped front adapted to lift the latch tab for releasing the module from the cage. The top wall needs to have a thickness sufficient to form a pocket for receiving the wedge-shaped front of the integrated structure. The need for increased thickness adjacent the post is detrimental to changing the module into a smaller and thinner style.

U.S. Pat. No. 6,926,551, issued to Schulz et al. on Aug. 9, 2005, discloses a pluggable transceiver having a housing and a release mechanism mounted thereon. The transceiver is inserted into a cage having a latch tab with a receiving hole. The housing has a cam configured to be latched with the receiving hole of the latch tab. The release mechanism is attached to the housing and selectively movable between a first position and a second position to release the cam from the receiving hole. The release mechanism has a chamfered, guiding surface to release the latching tab from the cam of the housing. Thus, the release mechanism needs a space sufficient for permitting a sliding movement from the first position to the second position. The need for a large space is not beneficial to designing the transceiver into a smaller and thinner style either.

Hence, a plug having an improved release mechanism for obtaining a thinner and smaller profile is desired.

SUMMARY OF THE INVENTION

Accordingly, an object of the present invention is to provide a plug configured for latching engagement with a cage which has a top wall to form a latch tab thereon. The plug includes a housing and a release mechanism assembled to the housing. The housing has a front mating portion and a top wall forming a nose portion thereon. The nose portion is adapted for locking with the latch tab. The release mechanism is mounted on the top wall of the housing. The release mechanism has a lever rotatable mounted onto the top wall of the housing and an actuator arm disposed between the lever and the top wall of the housing. The lever has a front portion adjacent to the nose portion, a rear portion opposite the front portion and a middle portion. The actuator arm is selectively movable along a front to back direction between a first position and a second position. The actuator arm could lift the front portion of the lever for releasing the nose portion from the latch tab in response to a movement of the actuator arm from the first position to the second position. The actuator arm could lift the rear portion of the lever while actuating the front portion of the lever down to a locking position, in response to a movement of the actuator arm from the second position to the first position.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
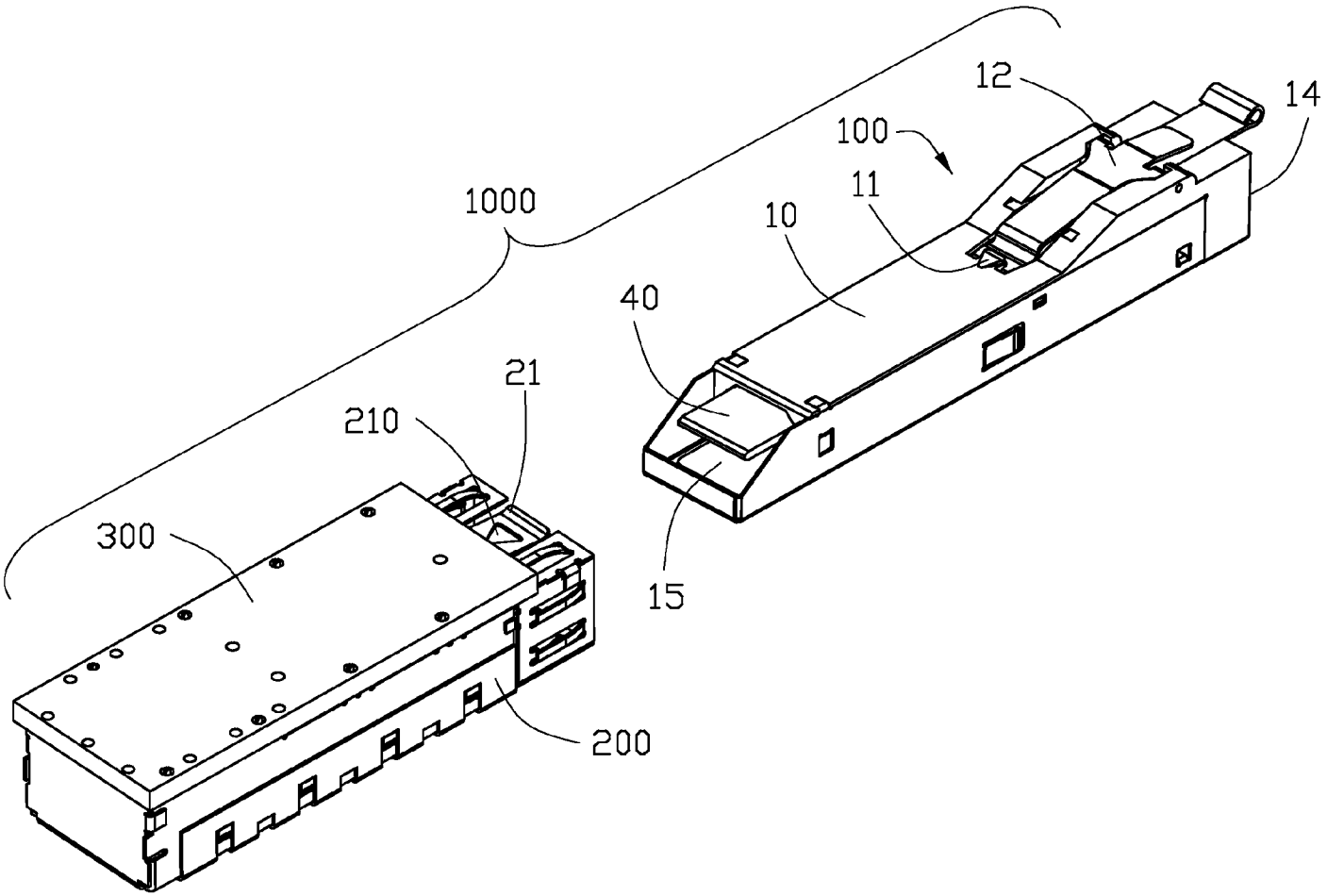
FIG. 1 is an assembled perspective view showing a connecting system constructed in accordance with the present invention.
Figure 2:
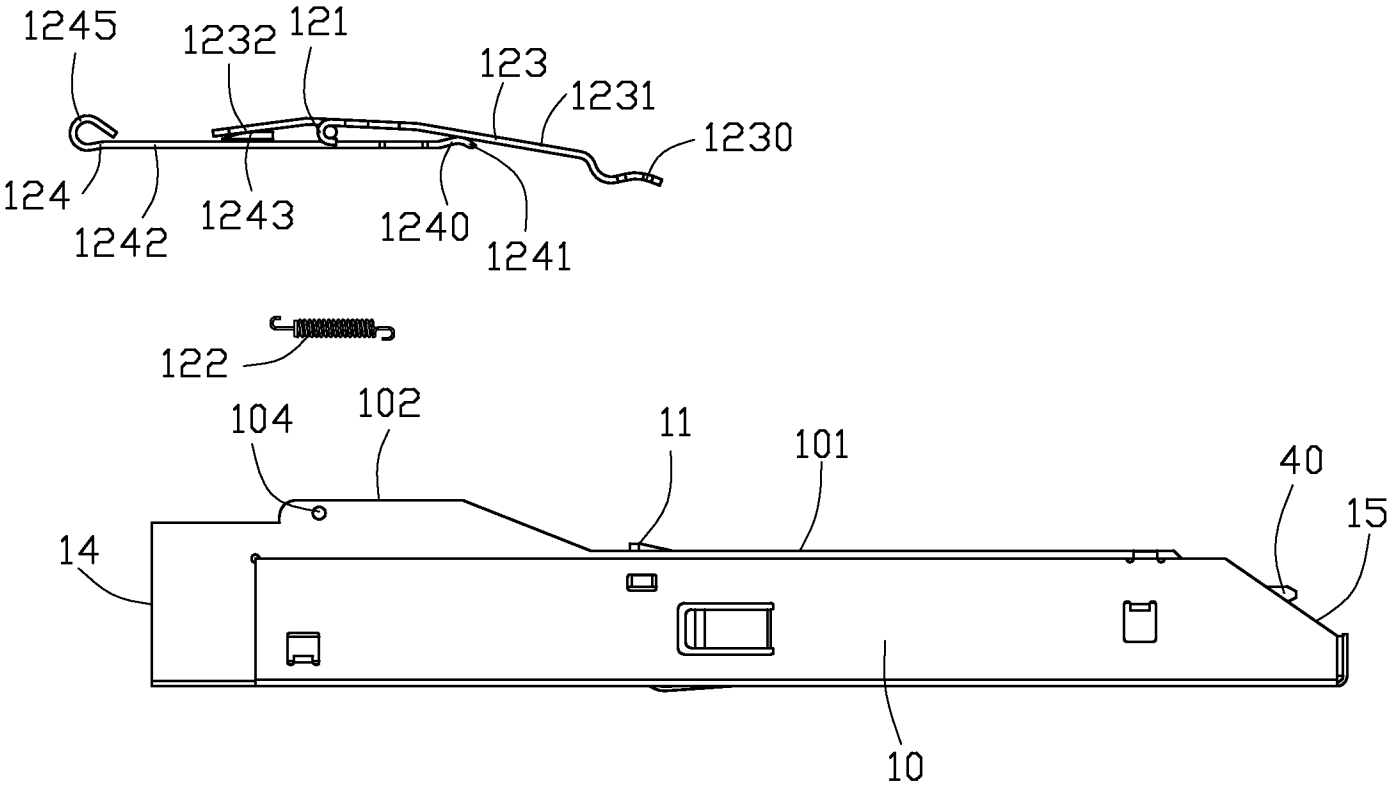
FIG. 2 is a partially exploded perspective view showing the plug as shown in FIG. 1.
Figure 3:
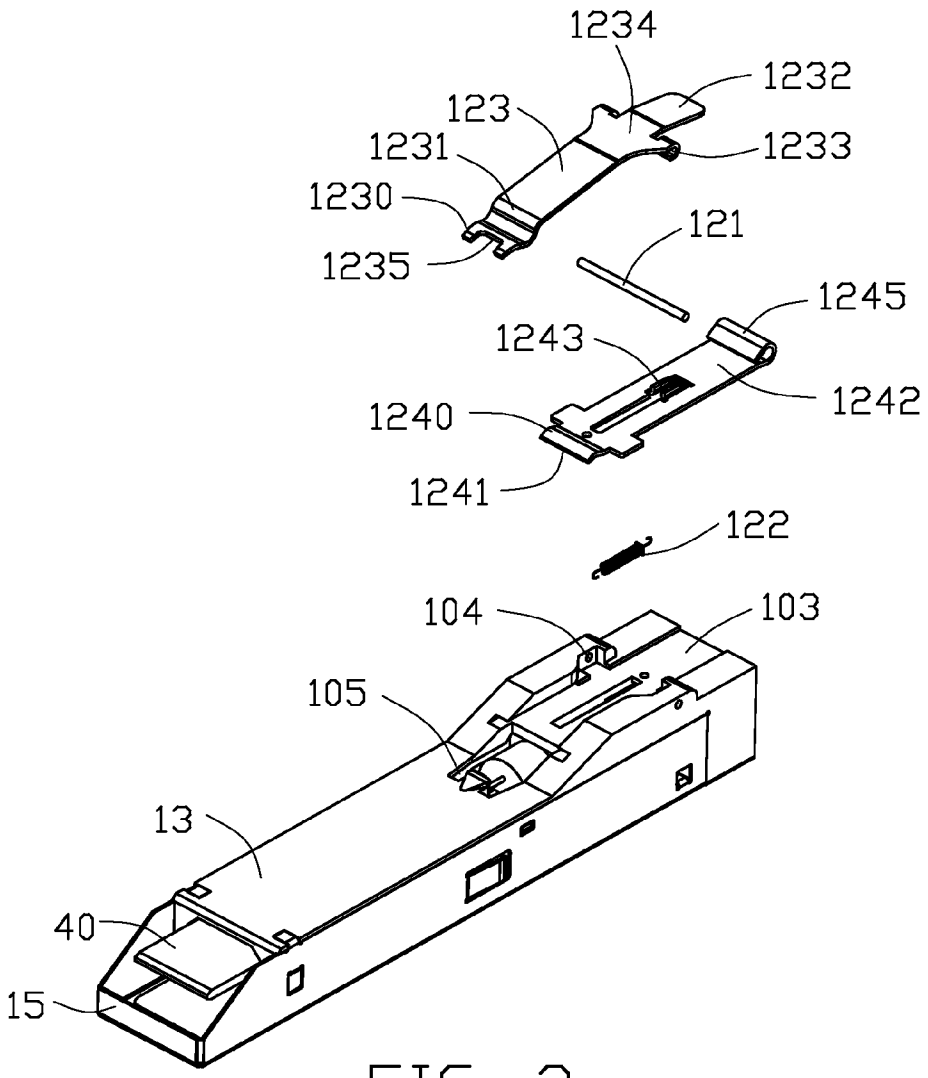
FIG. 3 is an exploded perspective view showing the release mechanism as shown in FIG. 1.
Figure 4:
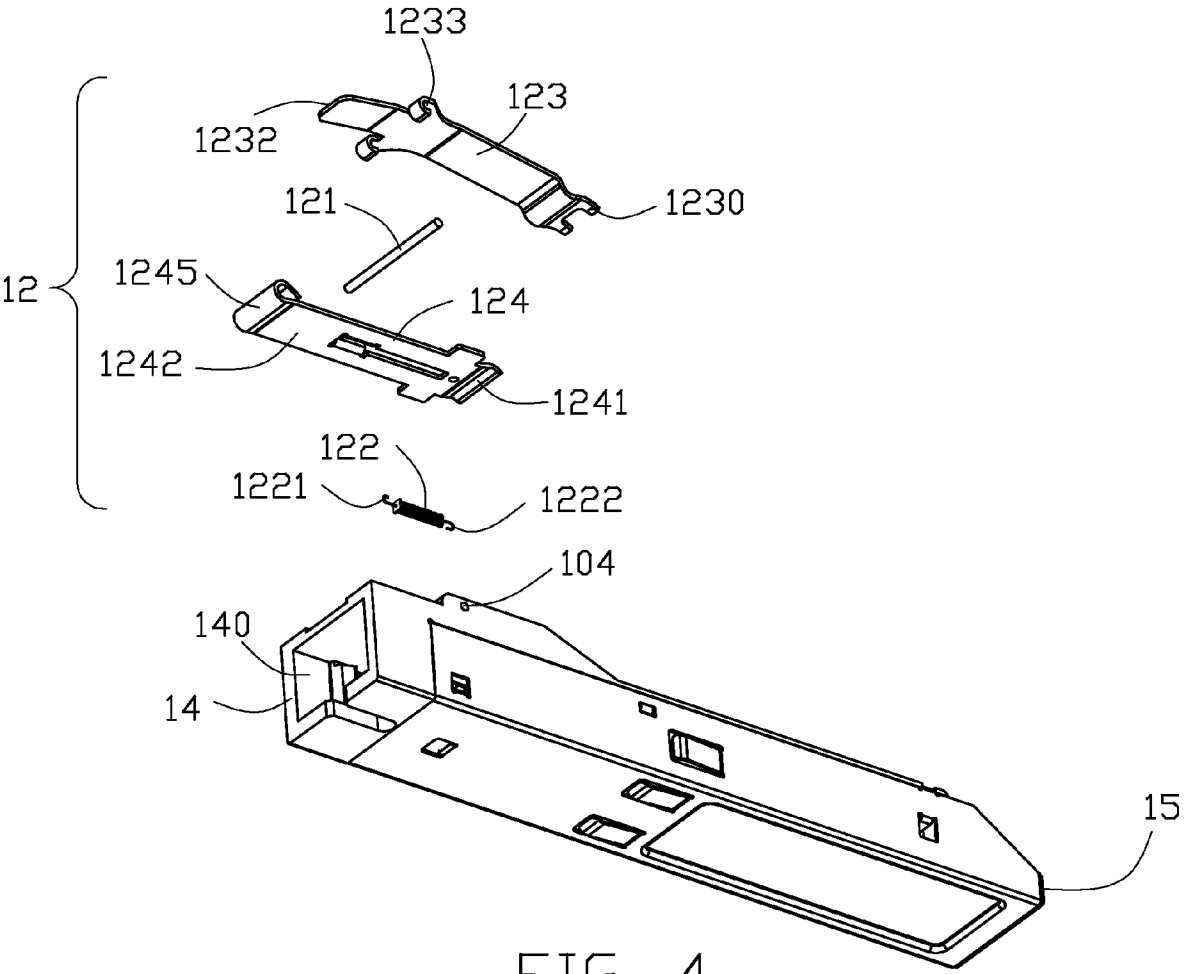
FIG. 4 is another exploded perspective view of the release mechanism as shown in FIG. 3.

Referring to FIGS. 1-4, a connecting system 1000 includes a cage 200 and a plug 100 configured for latching engagement with the cage 200. The cage 200 has a cavity (not shown) configured for at least receiving a part of the plug 100. The cage 200 is adapted to be assembled onto an outer circuit board 300 and having a top wall (not numbered) forming a resilient latch tab 21 thereon. The latch tab 21 defines a latching hole 210 configured for latching the plug 100 when the plug 100 is inserted into the cage 200 completely. The cage 200 surrounds a receptacle connector (not shown) which is mounted onto the circuit board 300 for mating with the plug 100.

The plug 100 includes a housing 10 and a release mechanism 12 assembled to the housing 10. The housing 10 has a front mating portion 15, a rear connecting portion 14 and a top wall 13 protruding a nose portion 11 thereon. The nose portion 11 is configured for locking with the latching hole 210 on the latch tab 21 to secure the plug 100 in the cage 200. Essentially, the housing 10 has a front part 101 adapted to be inserted into the cage 200, and a rear part 102 adapted to be exposed out of the cage 200. The front mating portion 15 has an opening (not numbered) to exposed a part of an inner board 40 adapted to mate with the receptacle connector. The rear connecting portion 14 has a mating port 140 configured for receiving a fibber optical connector (not shown) or any other suitable pluggable connectors.

The release mechanism 12 is mounted on the top wall 13 of the housing 10. The release mechanism 12 has a rotatable lever 123 mounted onto the top wall 13 of the housing 10, a movable actuator arm 124 settled between the lever 123 and the top wall 13 of the housing 10, a shaft 121 configured for connecting a middle portion 1234 of the lever 123 to the housing 10, and a resilient spring 122. The housing 10 has a pair of apertures 104 protruded from the top wall 13. The shaft 121 is transversely mounted into the aperture 104 adapted to hinge the middle portion 1234 of the lever 123. The spring 122 has a first end 1221 connecting with the housing 10 and a second end 1222 connecting with the actuator arm 124.

The lever 123 has a front portion 1231 adjacent to the nose portion 11, a rear portion 1232 adjacent to the connecting portion 14 and a middle portion 1234 having a mounting hole 1233 cooperated with the shaft 121. Thus, the lever 123 could be rotated around the shaft 121 between a locking position and a releasing position. The front portion 1231 of the lever 123 extends forwardly and downwardly from the middle portion 1234. The front portion 1231 further includes a pair of shoulder portions 1230 and defined an indentation 1235 therebetween. The nose portion 11 of the housing 10 could be received in the indentation 1235. The rear portion 1232 of the lever 123 extends backwardly and downwardly from the middle portion 1234. In order to obtain a thinner plug 100, the housing 10 may be manufactured more and more thinner, in this embodiment, the top wall 13 has a receiving room 105 to receive the shoulder portions 1230. The receiving room 105 having a depth greater than the thickness of the shoulder portion 1230.

The actuator arm 124 is attached to the top wall 13 of the housing and selectively movable between a first position and a second position along a back to front direction in a receiving slot 103 positioned on the top wall 13. The actuator arm 124 has a front (abutment) protrusion 1240 extending upwardly from a front portion 1241 of the actuator arm 124. The front protrusion 1240 is configured for cooperating with the front portion 1231 of the lever 123 and lifting the front portion 1231 up to the releasing position for releasing the nose portion 11 from the latch tab 21 when the actuator arm 124 is moved from the first position to the second position. The actuator arm 124 further has a rear (abutment) protrusion 1243 adjacent to a rear portion 1242 of the actuator arm 124. The rear protrusion 1243 cooperates with the rear portion 1232 of the lever 123. The rear protrusion 1243 is configured for lifting the rear portion 1232 of the lever 123 up and meanwhile putting the front portion 1231 down when the actuator arm 124 is moved from the second position to the first position. In this embodiment, the front protrusion 1240 and the rear protrusion 1243 are integrally punched along with the actuator arm 124 from a metal sheet. In some embodiments, the front protrusion 1240 and the rear protrusion 1243 may be manufactured separately and assembled to the actuator arm 124. The rear portion 1242 of the actuator arm 124 further has a operating part 1245 extending backwardly. The operating part 1245 is crimped into an arc shaped for user operating conveniently.

The spring 122 is elongated or compressed when the actuator arm 124 is moved from the first position to the second position. The deformation of the spring 122 provides a return force to move the actuator arm 124 back from the second position to the first position. At the same time, the lever 123 is forced to rotate from the releasing position back to the locking position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug configured for latching engagement with a cage having a latch tab, comprising:

a housing having a front mating portion and a top wall, the top wall having a nose portion adapted for locking with the cage latch tab; and a release mechanism mounted on the top wall of the housing, said release mechanism comprising:

a lever having a front portion adjacent to the nose portion, a rear portion opposite the front portion, and a middle portion; and an actuator arm disposed between the top wall of the housing and the lever, said actuator arm movable along a front to back direction between a first position and a second position;

wherein the actuator arm lifts the front portion of the lever for releasing the nose portion from the latch tab in response to a movement of the actuator arm from the first position to the second position, and the actuator arm lifts the rear portion of the lever in response to a movement of the actuator arm from the second position to the first position;

wherein the release mechanism further includes a resilient spring having a first end connected with the actuator arm, and a second end connected with the top wall of the housing;

wherein the release mechanism further includes a shaft transversely mounted on the top wall, said middle portion of the lever having a mounting hole cooperated with the shaft;

wherein the front portion of the lever extends forwardly and downwardly from the middle portion, and the rear portion extends backwardly and downwardly from the middle portion;

wherein the front portion of the actuator arm has a front protrusion extending upwardly and configured for lifting the front portion of the lever into a releasing position, and the rear portion of the actuator arm has a rear protrusion extending upwardly and configured for lifting the rear portion of the lever to actuate the front portion of the lever into a locking position; and wherein the actuator arm including the front and rear protrusions is made of an one-piece metal sheet.

2. The plug as claimed in claim 1, wherein the front portion of the lever has a pair of shoulder portions defining an indentation therebetween, said nose portion of the housing received in the indentation.

3. The plug as claimed in claim 2, wherein the top wall has a receiving room to receive the shoulder portions, said receiving room having a depth greater than the thickness of the shoulder portion.

4. A connecting system comprising:

a cage having a top wall forming a resilient latch tab thereon;

a pluggable connector, comprising:

a housing having a front mating portion, a rear connecting portion, and a top wall extending between the front mating portion and the rear connecting portion, the top wall having a nose portion adapted for locking with the latch tab;

a release mechanism mounted on the top wall of the housing, said release mechanism having: a lever having a front portion adjacent to the nose portion, a rear portion adjacent to the connecting portion and a middle portion hinged onto the top wall of the housing;

an actuator arm disposed between the top wall of the housing and the lever, said actuator arm movable along a front to back direction between a first position and a second position;

wherein the actuator arm has a front protrusion to lift the front portion of the lever for releasing the nose portion from the latch tab in response to a movement of the actuator arm from the first position to the second position, and the actuator arm has a rear protrusion to lift the rear portion of the lever in response to a movement of the actuator arm from the second position to the first position;

wherein the release mechanism further includes a resilient spring having a first end connected with the actuator arm, and a second end connected with the top wall of the housing;

wherein the release mechanism further includes a shaft transversely mounted on the top, said middle portion of the lever having a mounting hole hinged with the shaft;

wherein the front portion of the lever extends forwardly and downwardly from the middle portion, and the rear portion extends backwardly and downwardly from the middle portion; and wherein the front protrusion extending upwardly from the front portion of the actuator arm, and the rear protrusion extending upwardly from the rear portion of the actuator arm.

5. The connecting system as claimed in claim 4, wherein the actuator arm including the front and rear protrusions is made of an one-piece metal sheet.

6. The connecting system as claimed in claim 5, wherein the front portion of the lever has a pair of shoulder portions defining an indentation therebetween, said nose portion of the housing received in the indentation.

7. A connecting system comprising:

a pluggable connector including:

a housing having a front mating portion, a rear connecting portion, a to wall and a nose portion for locking with a latch tab of a cage in which the housing is received;

a release mechanism disposed upon the housing behind the nose portion in a front-top-back direction;

a lever having a middle portion hinged to the housing so as to have said lever pivotal relative to the housing about said middle portion between inner and outer positions, and a front portion moveable located in front of the middle portion and moveable around the nose portion, and a rear portion located behind the middle portion;

an actuator arm intimately behind the lever in a vertical direction perpendicular to said front-to-back direction, said actuator mounted to the housing and linearly moveable with regard to the housing in the front-to-back direction between front and rear positions, said actuator arm including a front abutment protrusion confronting the front portion of the lever in both the front-to-back direction and the vertical direction, and a rear operation section for accessible by a user, a rear abutment protrusion located between the front abutment protrusion and the rear operation section and confronting the rear portion of the lever in both the front-to-back direction and the vertical direction; and a resilient spring connected between the housing and the actuator to urge the actuator to move rearward when deformed;

wherein when the actuator arm is forcibly forwardly moved toward the front position by the user imposing forces upon the rear operation section, the front abutment protrusion pushes the front portion of the lever outwardly to reach the outer position for outwardly deflecting and releasing the latch tab from the nose portion; when the user releases the actuator arm, the actuator arm is moved rearwardly by the resilient device toward the rear position, and the rear abutment protrusion pushes the rear portion of the lever outwardly to reach the inner position for relieving and having the latch tab in a relatively relaxed manner; and wherein the release mechanism further includes a shaft transversely mounted on the top wall, said middle portion of the lever having a mounting hole cooperated with the shaft.

* * * * *